US006935063B1

(12) United States Patent
Johnson

(10) Patent No.: US 6,935,063 B1
(45) Date of Patent: Aug. 30, 2005

(54) TRIPLE-BARREL SHOTGUN

(76) Inventor: Steve M. Johnson, 418 Christian Bend Rd., Church Hill, TN (US) 37642

( * ) Notice: Subject to any disclaimer, the term of this patent is extended or adjusted under 35 U.S.C. 154(b) by 0 days.

(21) Appl. No.: 10/830,995

(22) Filed: Apr. 26, 2004

(51) Int. Cl.[7] ..... F41A 3/00
(52) U.S. Cl. ..... 42/40; 42/42.02; 42/42.03; 42/75.04; 89/1.41
(58) Field of Search ..... 42/40, 42.02, 42.03, 42/75.04; 89/1.41

(56) References Cited

U.S. PATENT DOCUMENTS

| | | | | | |
|---|---|---|---|---|---|
| 308,513 | A | * | 11/1884 | Newcomb | 42/70.08 |
| 367,089 | A | * | 7/1887 | Brown | 42/40 |
| 441,389 | A | * | 11/1890 | Brooks | 42/40 |
| 1,599,008 | A | * | 9/1926 | Diener | 42/76.01 |
| 6,052,935 | A | * | 4/2000 | Howard | 42/79 |

FOREIGN PATENT DOCUMENTS

| | | | |
|---|---|---|---|
| GB | 0000921 | * | 3/1875 |
| GB | 268239 | * | 3/1927 |

OTHER PUBLICATIONS

The Gun and Its Development by W.W. Greener, 1910, pp. 493-495, 501, 505-507.*

* cited by examiner

*Primary Examiner*—J. Woodrow Eldred

(57) ABSTRACT

A break down triple-barrel shotgun includes three barrels, having two bottom barrels and one top barrel positioned on top of the two bottom barrels. In this respect, the triple-barrel shotgun has features of both side by side and over and under shotguns. The triple-barrel shotgun has simple break down mechanical features and provides increased shot opportunities with the reliability of a breakdown shotgun. As a result, the number of shells that are jammed is lowered or eliminated in comparison with conventional three shot shotguns. Also, the cleaning, maintenance, and care of a shotgun having a three shot capability is simplified in comparison with conventional three shot shotguns. The subject triple-barrel shotgun is especially useful for waterfowl hunting for which a maximum of three shot capability is mandated. The triple-barrel shotgun allows the use of three interchangeable choke tubes, that allow the shot patterns to be changed or adjusted with respect to pattern density.

4 Claims, 6 Drawing Sheets

TRIPLE-BARREL SHOTGUN

BACKGROUND OF THE INVENTION

1. Field of the Invention

The present invention relates generally to shotguns, and, more particularly, to multiple-barrel side by side and over and under shotguns.

2. Description of the Prior Art

As is well known, double barrel shotguns with side by side and over and under designs have been popular among sportsmen for hunting and sport shooting clay pigeons for many years, and a number of advantages are provided.

These designs provide the sportsman with two quick shot features with relatively low maintenance. Also, the simple mechanical breakdown features of double barrel shotguns provide the user with simple loading of ammunition and extraction of spent shot shells.

Still another advantage of break down shotguns is that they generally do not jam. Shot shells are ejected from mechanical links or ejectors that are enabled when the shotgun is broken down. Compared to pump and automatic shotguns, shot shells are much less likely to jam in break down shotguns, which include single shot and double barrel actions.

The main disadvantage of break down shotguns, such as over and under shotguns, as compared to pump and automatic shotguns is diminished shell capacity. Although automatic and pump shotguns have the capacity to hold up to five or more shells, most state and federal laws, especially related to hunting waterfowl, limit the guns capacity to hold a maximum of three shells. By holding three shells, automatic and pump shotguns hold a major advantage over two shot double barrel shotguns. Patents in this field include U.S. Pat. Nos. 1,217,347; 2,736,119; 2,981,155; 3,339,304; 4,265,044; 2,711,042; 3,016,645; 3,421,243; 3,537,203; 4,685,236; and 4,989,359, all of which are incorporated herein by reference.

SUMMARY OF THE INVENTION

The present invention and its preferred embodiments incorporate a new design of a break down shotgun which includes three barrels with interchangeable screw-in choke tubes. This is a major advantage over traditional double barrel designs. This new design incorporates the classic style of over and under and side by side double barrels into one gun. The three shot capacity and the simple mechanical ejection, of traditional over and under shotguns, will provide the hunter/sportsman with a truly unique, dependable, and low maintenance gun. In addition, this new design combines features of both over and under design and side by side double barrel shotguns, with an additional barrel being added, to provide a break down triple barrel shotgun.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved triple-barrel shotgun which has all of the advantages of the prior art and none of the disadvantages.

It is another object of the present invention to provide a new and improved triple-barrel shotgun which may be easily and efficiently manufactured and marketed.

It is a further object of the present invention to provide a new and improved triple-barrel shotgun which is of durable and reliable construction.

An even further object of the present invention is to provide a new and improved triple-barrel shotgun which is susceptible of a low cost of manufacture with regard to both materials and labor, and which accordingly is then susceptible of low prices of sale to the consuming public, thereby making such triple-barrel shotgun available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood after a study of the following detailed description thereof. Such description makes reference to the annexed drawing wherein.

DESCRIPTION OF THE PREFERRED EMBODIMENT

With reference to the drawings, a new and improved triple-barrel shotgun embodying the principles and concepts of the present invention will be described.

Figure 1:
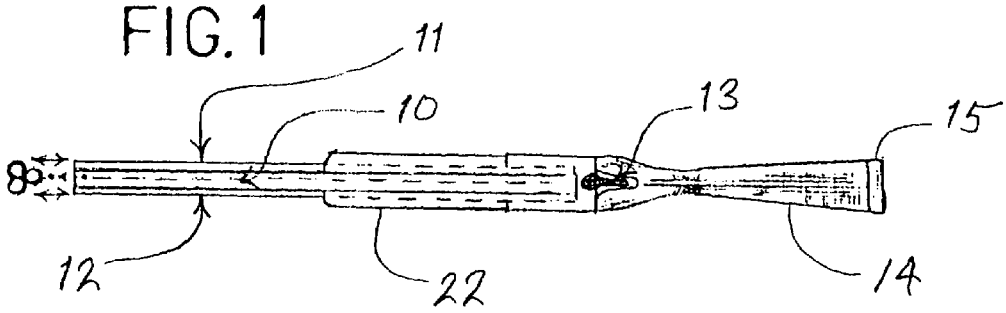
FIG. 1 is a top plan view a preferred embodiment of the triple-barrel shotgun of the invention.

In FIG. 1, the preferred triple-barrel shotgun of the invention includes a top barrel 10 resting between the bottom side barrels 11 and 12. These three barrels, i.e. the top barrel 10 and the bottom side barrels 11 and 12, are connected to the hand-gripping portion of the stock 22. This portion of the gun is connected pivotally to the rear portion of the gun stock 14. The gun can be placed in the open breech position by pushing the breech down lever 13 to the side. The rear portion of the gun stock 14 shows the addition of a pad 15 to help absorb recoil from the onset of the gun firing a shell.

Figure 2:
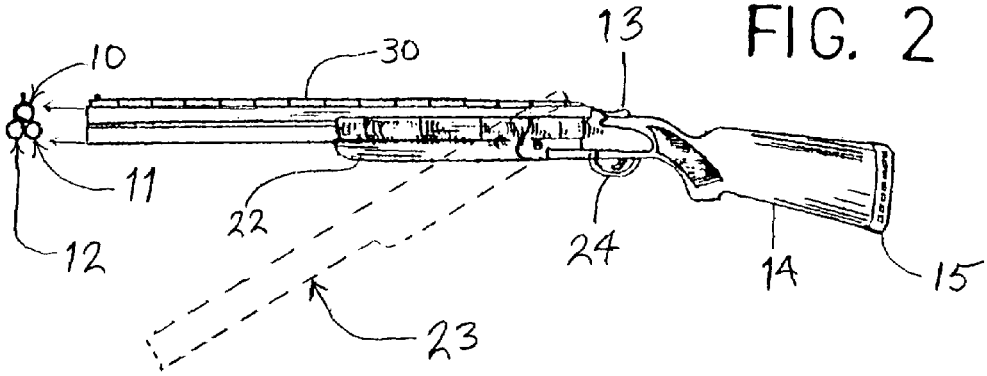
FIG. 2 is a side view of the embodiment of the triple-barrel shotgun shown in FIG. 1, wherein the dashed outline shows the gun with the breech in the open position.

FIG. 2 shows the top barrel 10 and the bottom side barrels 11 and 12 arranged in the preferred triangular formation. The dashed line 23 shown in FIG. 2 shows the gun's would-be position with the breech open, which would be utilized by pushing the breech down lever 13 to the side. The trigger assembly 24 is shown and enables the individual to pull the trigger to allow the gun to fire. Various trigger assemblies and fire pin arrangements could be used with the present invention including multiple triggers to achieve intended results of firing ammunition in sequence order with regard to the three barrel arrangement.

Figure 3:
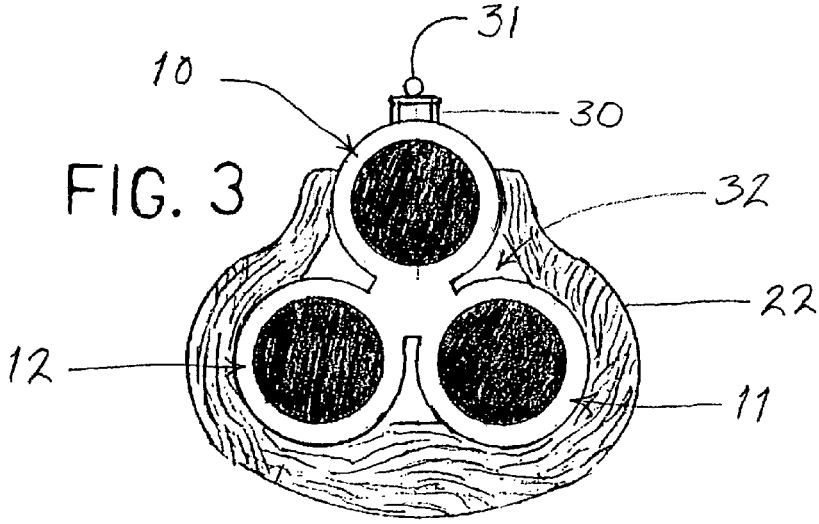
FIG. 3 is an enlarged front view of the embodiment of the triple-barrel shotgun of FIG. 2.

With reference to the top barrel 10, a ventilated rib 30 is attached to help in heat dissipation and also in sighting with the sight bead 31 shown in detail in FIG. 3.

In FIG. 3, the top barrel 10 and the bottom side barrels 11 and 12 are shown to be arranged in the triangular arrangement. Alternatively, the three barrels could be arranged in a vertical line or in an inverted triangular arrangement.

The hand-gripping portion of the stock 22 can be comprised of wood or other natural materials or synthetic materials. A spacer component 32 could be utilized to insulate the barrels from one another and reduce the overall weight of the gun.

Figure 4:
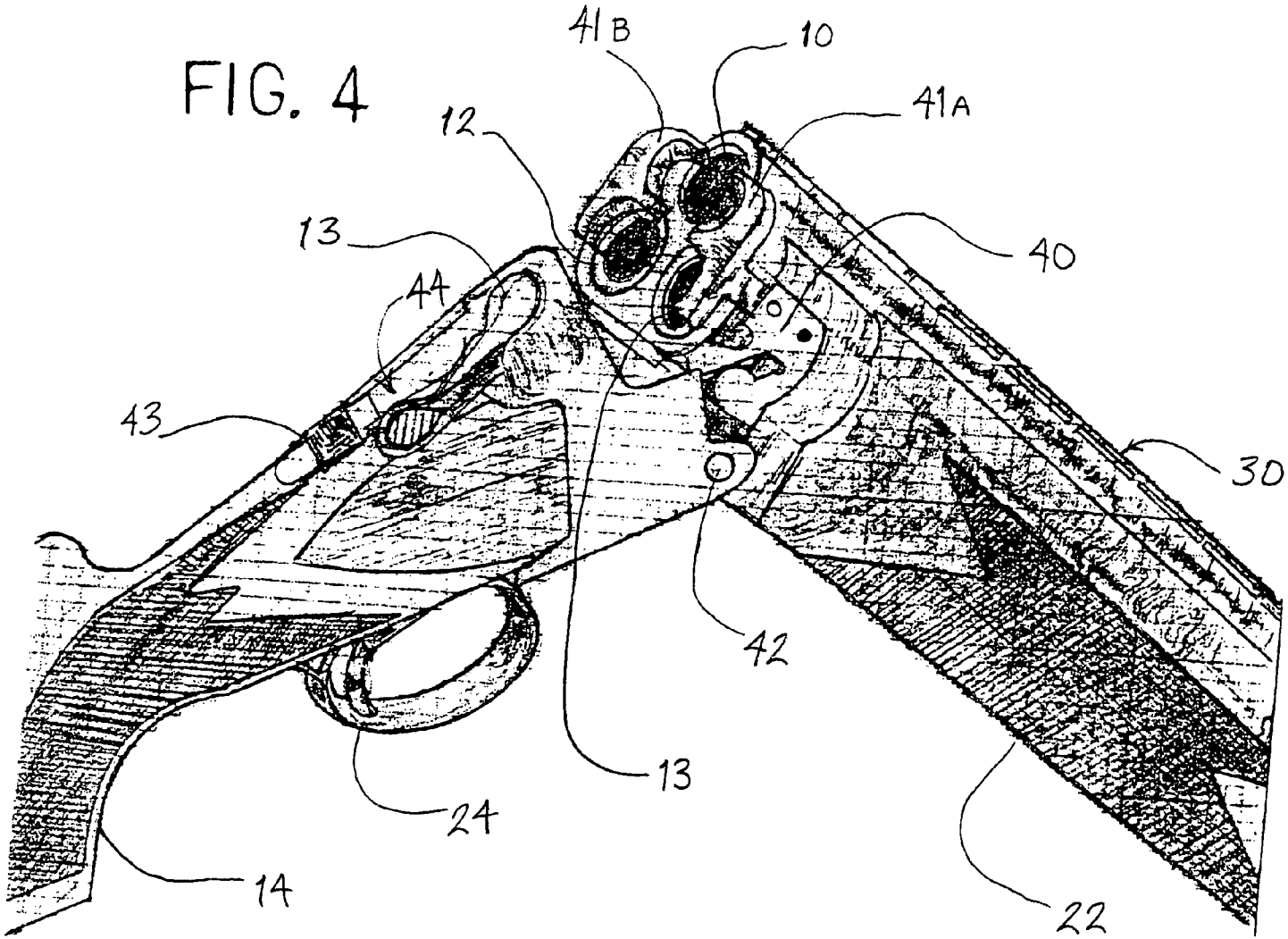
FIG. 4 is a perspective view of the preferred embodiment of the invention, wherein the breech is in the open position, clearly showing three barrels.

In FIG. 4, the breech is shown open. The breech down lever 13 is pushed 44 to the side enabling the gun to break down. This action ejects shells from the top barrel 10 and the bottom side barrels 11 and 12 and engages the breech ejection assembly 40 along with the shell ejection arms 41*a* and 41*b*. The shell ejection arms 41*a* and 41*b* are rimmed to allow all three shot shells to be ejected once the gun is in the open breech position. The break down open breech position of the gun pivots on a rod 42. The safety and/or barrel selection switch 43 is located behind the break down lever 13. The trigger assembly 24 is attached to the rear portion of the gun stock 14. The ventilated rib 30, which is used for heat dissipation, is attached to the top barrel 10.

Figure 5:
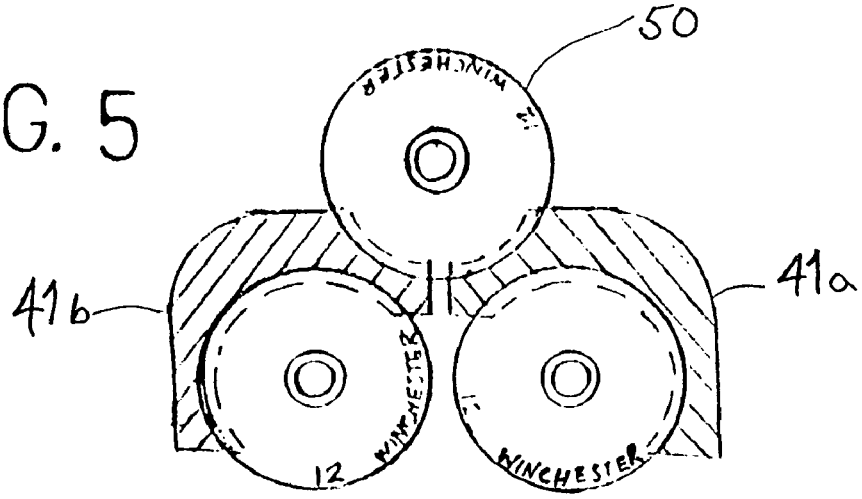
FIG. 5 is a front view of the shell ejection assembly loaded with three shotgun shells in place.
Figure 6:
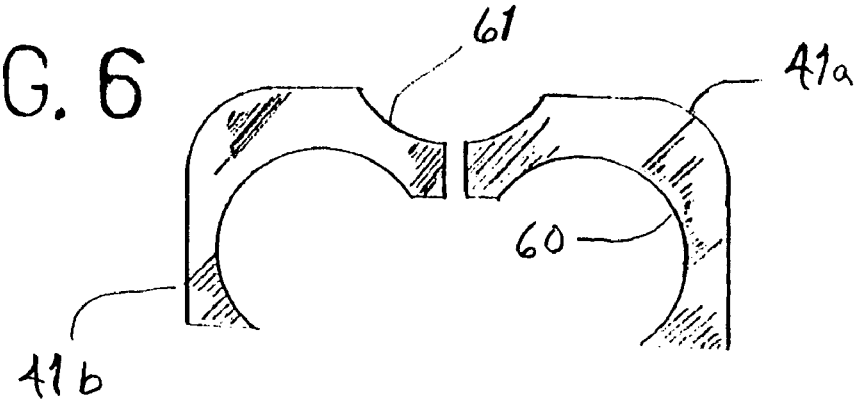
FIG. 6 shows the right and left shell ejection assembly arms with no shells present.
Figure 7:
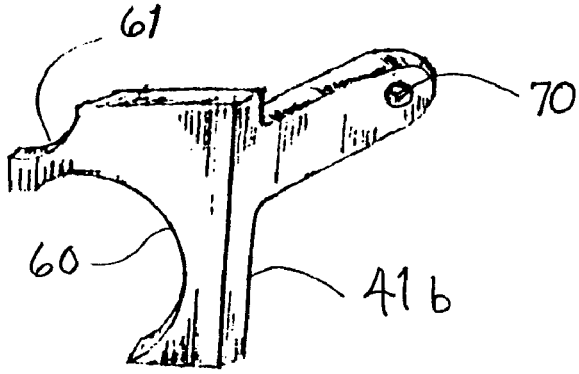
FIG. 7 is a perspective view of one of the shell ejector arms.

FIGS. 5, 6, and 7 show an exemplary arrangement of the shell ejector arm assembly that would be needed to unload three shotgun shells. FIG. 5 shows the shell ejection arms 41*a* and 41*b* holding the rims 50 of the shotgun shells in place. The shotgun shell rims 50 set up and overlap on the concave portions 60 and 61 shown in FIG. 6. FIG. 7 shows the shell ejection arm 41*a* in a perspective view. The ejector is connected to the barrel and pivots breakdown position of the shotgun by alignment hole 70.

Figure 8:
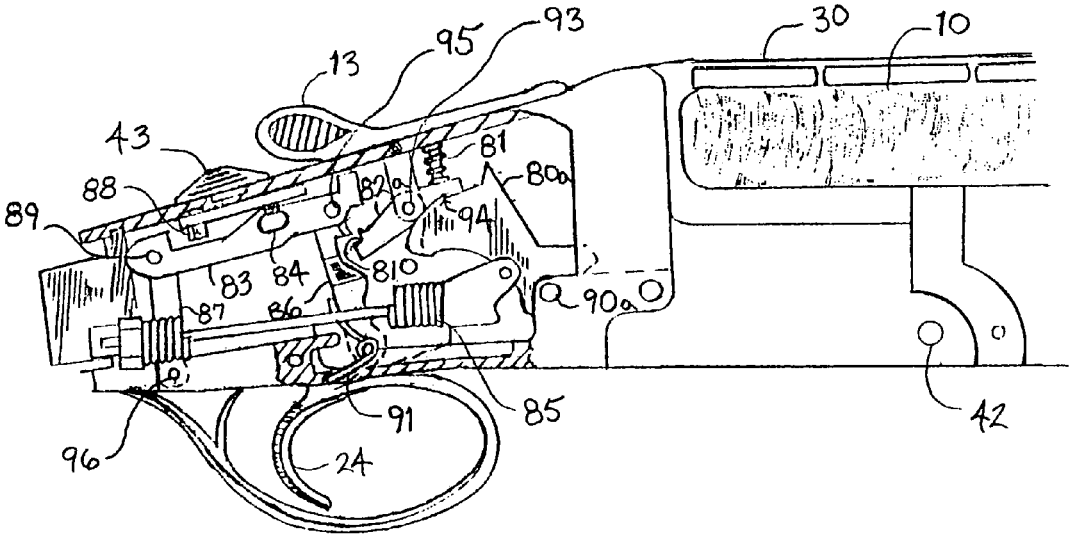
FIG. 8 is a partially exposed side view of the preferred embodiment of the invention showing trigger and firing mechanisms.
Figure 9:
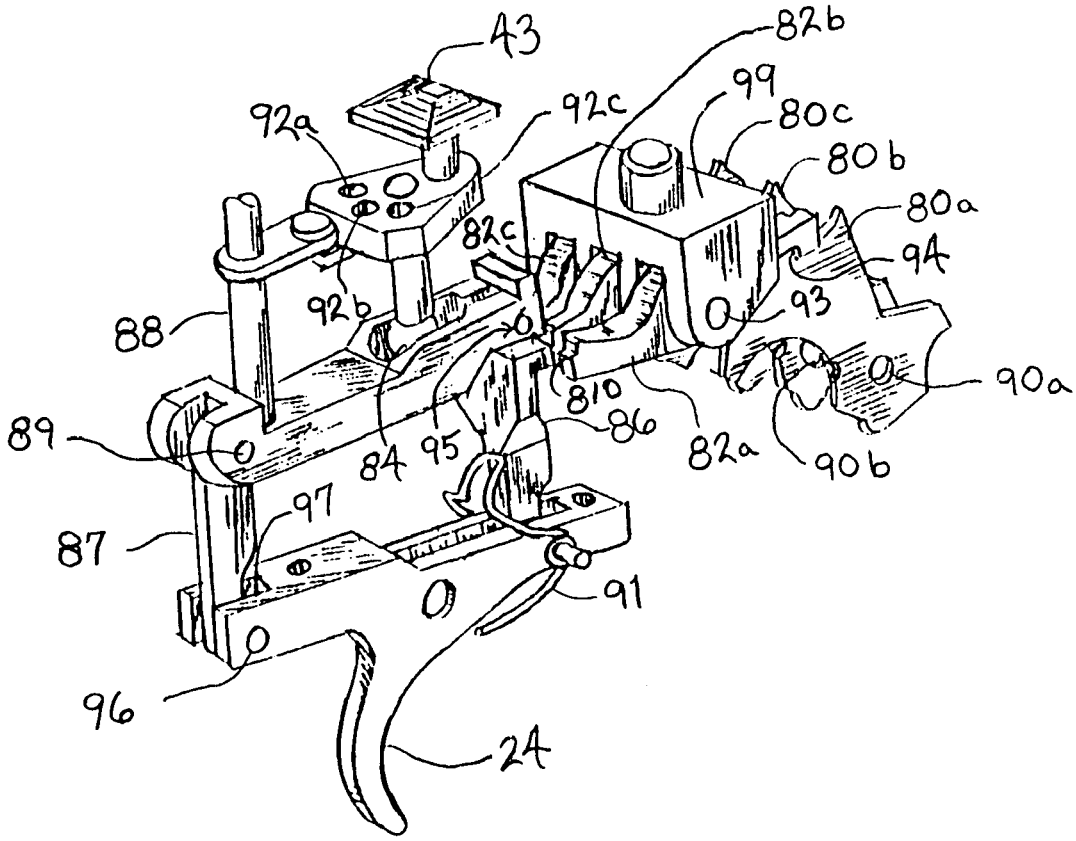
FIG. 9 show a fragmentary perspective view of the trigger assembly, which includes an example of the sear and hammer arrangement needed to accommodate a three-barrel shotgun.

FIG. 8 shows a side view drawing of a break down shotgun with the trigger firing mechanism assembly, sear 82*a* and hammer 80*a* arrangement exposed. The top barrel 10 of the three-barrel arrangement is exposed while the two bottom side barrels 11 and 12 are hidden. The breakdown pivotal rod 42 is shown which allows the shotgun to be broken down in the breech open position. The frontal portion and barrel assembly of the shotgun is allowed to fall when the break down lever 13 is pushed to one side. The forwardly biased trigger assembly 24 connects to the connector arm 86 by the pivotal rod 42 and spring assembly 91. The connector arm 86 by the pivotal rod 42 and spring assembly 91. The connector arm 86 then engages one of the three sears labeled 82*a*, 82*b*, and 82*c* when the trigger 24 is pulled. A clear view of all three sears 82*a*, 82*b*, and 82*c* along with the three hammers 80*a*, 80*b*, and 80*c* can be shown in perspective from in the detail drawing in FIG. 9. When the connector arm 86 makes contact with one of the sears 82*a*, 82*b*, and 82*c*. The sear then pivots downward on the pivotal rod 93 thus disengaging the selected hammer from the holding notch 94 thus allowing the strong spring assembly 85 to push forward engaging the hammer to the firing pin (not shown). The hammer 80*a*, 80*b*, or 80*c* when in forward motion, pivots on pivotal rod 90*a*. The selector and safety switch 43 can be moved in a forward or backward motion to engage safety and a side to side motion to select one or the three-barrel arrangements to be fired first. By pushing the barrel selector and safety switch 43 forward, the gun is now ready to be fired. The side to side sliding switch selects which barrel is to be fired by the alignment of holes 92*a*, 92*b*, and 92*c*. The forward motion of the selector switch is allowed by the ball and groove arrangement labeled 84 in FIGS. 8 and 9. Thus, when the pivot rod and ball 84 is in the back of the groove, the extension lever 87 which is connected by pivotal rod 96 to the rear portion of the trigger 24, is locked tangent to the trigger 24 allowing the trigger 24 to be locked or in the safety position. The connector arm 83 which is connected to the selector switch 43 by pivoting rod, ball, and groove assembly 84 and also connected at pivotal rod 89 and pivotal rod 95.

Now referring back to the three sear engagements labeled 82*a*, 82*b*, and 82*c*, the selected sear is connected by pivotal rod 93 to the sear housing labeled 99. Each sear 82*a*, 82*b*, and 82*c* is biased downwardly by coiled springs 81 shown in FIG. 8. The downward biasing effect of the coiled springs 81 engages the selected sear 82*a*, 82*b*, and 82*c* to its respective hammers 80*a*, 80*b*, or 80*c* at point 94, thus holding the gun in the cocked position. When the trigger 24 is pulled backward, the connector arm 86 is biased in forward motion and makes contact at point 810 on the selected sear 82*a*, 82*b*, and 82*c*. This in turn pushes the coiled springs 81, which in turn lifts the frontal portion of the sear in an upward biased motion. The latching point 94 is then disengaged from the selected sear and hammer. This allows the strong spring assembly 85 to drive the hammer in a quick forward biasing motion otherwise known as lock time. The hammer then strikes the firing pin assembly (not shown) with enough force to successfully allow the pin to indent the primer on the shotgun shell thus igniting the powder and firing the shotgun shell.

Figure 10:
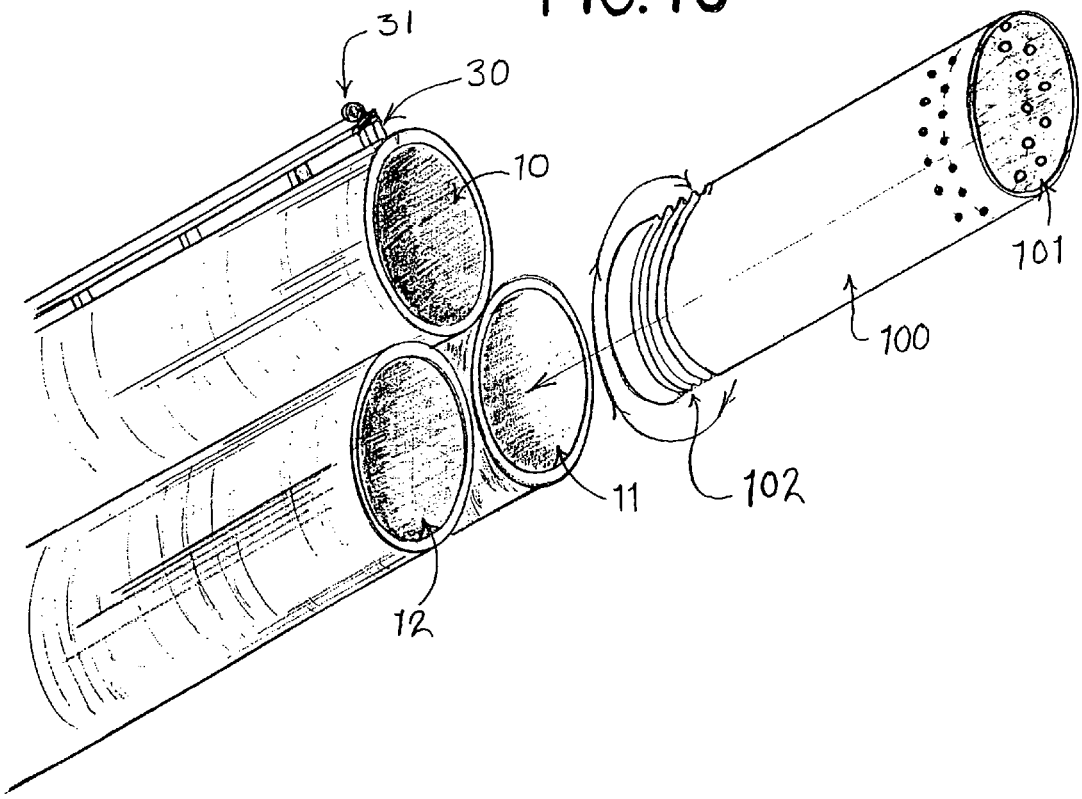
FIG. 10 shows a perspective view of the frontal portion of the three-barrel arrangement with a screw-in choke tubes removed.

FIG. 10 shows the top barrel 10 and the bottom side barrels 11 and 12. The screw-in choke tube 100 is shown removed from barrel 11. The choke tube 100 has a ported frontal portion 101 with screw threads 102 that engage matching threads embedded in the top barrel 10 and the bottom side barrels 11 and 12.

As to the manner of usage and operation of the instant invention, the same is apparent from the above disclosure, and accordingly, no further discussion relative to the manner of usage and operation need be provided.

Thus, while the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A break down shotgun, comprising:

a stock, three barrels supported by said stock, wherein said three barrels receive three shotgun shells, and a firing mechanism supported by said stock for firing the three shotgun shells, wherein said three barrels are arranged in a triangular form pointing upward, having two bottom barrels side by side and one top barrel resting on top of said two bottom barrels and centrally located between said two bottom barrels, said shot gun further including:

a shell elector and arm assembly, supported by said stock, for electing three shotgun shells from said three barrels, wherein said firing mechanism includes three sears and three hammers and at least one trigger, wherein said hammers can move in a forward motion to engage a firing pin for a selected barrel, further including a barrel selector and safety trigger locking mechanism supported by said stock, and further including interchangeable choke tubes received by said three barrels.

2. The shotgun of claim 1 wherein said hammers can move in a forward motion to engage a firing pin for a barrel in a barrel sequence.

3. The shotgun of claim 1 wherein said three barrels can be fired in sequential order.

4. The shotgun of claim 1 wherein said firing mechanism includes three triggers.

* * * * *